US007973480B2

(12) United States Patent
Marien et al.

(10) Patent No.: US 7,973,480 B2
(45) Date of Patent: Jul. 5, 2011

(54) HIGH-PRESSURE DISCHARGE LAMP HAVING AN OUTER ENVELOPE ARRANGED AROUND A DISCHARGE VESSEL

(75) Inventors: Leo Gustaaf Joanna Emiel Marien, Westerlo (BE); Willibrordus Spijker, Best (NL); Nancy Jean Caruso, Turnhout (BE); Jean-Francois Lavaud, Bergerac (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 108 days.

(21) Appl. No.: 12/480,110

(22) Filed: Jun. 8, 2009

(65) Prior Publication Data

US 2009/0243487 A1 Oct. 1, 2009

Related U.S. Application Data

(63) Continuation of application No. 10/546,317, filed as application No. PCT/IB2004/050140 on Feb. 24, 2004, now Pat. No. 7,550,924.

(30) Foreign Application Priority Data

Feb. 27, 2003 (EP) ..... 03290472

(51) Int. Cl.

| | |
|---|---|
| ***H01J 17/16*** | (2006.01) |
| ***H01J 19/42*** | (2006.01) |
| ***H01J 17/00*** | (2006.01) |
| ***H01J 9/00*** | (2006.01) |

(52) U.S. Cl. ..... 313/634; 313/317; 313/318.01; 313/318.12; 313/324; 313/567; 445/24; 445/25

(58) Field of Classification Search ..... None
See application file for complete search history.

(56) References Cited

U.S. PATENT DOCUMENTS

| | | | | |
|---|---|---|---|---|
| 2,175,361 | A * | 10/1939 | Reger et al. | 313/25 |
| 3,364,374 | A | 1/1968 | Wilson | |
| 3,882,346 | A | 5/1973 | McVey | |
| 3,785,020 | A | 1/1974 | Boros | |
| 4,066,926 | A | 1/1978 | Newton | |
| 5,751,095 | A | 5/1998 | Zalar | |
| 6,204,598 | B1 | 3/2001 | Bruggemann et al. | |
| 6,536,918 | B1 | 3/2003 | Boroczki et al. | |
| 6,661,176 | B2 | 12/2003 | Honda et al. | |
| 6,713,962 | B2 | 3/2004 | Nohara et al. | |
| 6,764,328 | B2 | 7/2004 | Van Dulmen et al. | |

FOREIGN PATENT DOCUMENTS

DE 102005026695 A1 12/2006

(Continued)

*Primary Examiner* — Natalie K Walford

(57) ABSTRACT

A high-pressure discharge lamp has an outer envelope (1) in which a discharge vessel (11) is arranged. The discharge vessel encloses a discharge space (13) with an ionizable filling. The discharge vessel has two mutually opposed neck-shaped portions (2,3) through which current supply conductors (4,5) extend to a pair of electrodes (6,7) in the discharge space. A lamp base (8) of electrically insulating material supports the discharge vessel. The lamp base also supports the outer envelope (1). The outer envelope encloses the current supply conductors and is connected to the lamp base in a gas-tight manner. By controlling the atmosphere in the outer envelope, a simplified and compact high-pressure discharge lamp is provided with an accurate positioning of the discharge vessel with respect to the optical axis of the lighting system. The high-pressure discharge lamp can be suitably applied in an assembly with a reflector.

18 Claims, 7 Drawing Sheets

FOREIGN PATENT DOCUMENTS

| | | | |
|---|---|---|---|
| DE | 102005047006 | A1 | 4/2007 |
| EP | 0160242 | A1 | 4/1985 |
| EP | 0902458 | A2 | 3/1999 |
| GB | 476836 | A | 12/1937 |
| JP | 04002035 | A | 1/1992 |
| WO | 0217350 | A | 2/2002 |
| WO | 2004107390 | A1 | 12/2004 |
| WO | 2006081806 | A2 | 8/2006 |

* cited by examiner

HIGH-PRESSURE DISCHARGE LAMP HAVING AN OUTER ENVELOPE ARRANGED AROUND A DISCHARGE VESSEL

This is a continuation of U.S. patent application Ser. No. 10/546,317, filed on Aug. 19, 2005.

The invention relates to a high-pressure discharge lamp.

The invention also relates to an assembly of such a high-pressure discharge lamp and a reflector.

High-pressure discharge lamps ranging from 35 to 150 W have become dominant in lighting retail applications. Trends have emerged which create positive conditions for range extensions towards lower lumen packages and/or lower wattages. Lower light levels are being used, for instance in exclusive shops, focusing the light on the goods instead of flooding the area. End users in the market become more and more interested in a uniform quality of the light and would prefer to employ high-pressure discharge lamps instead of halogen lamps for the low-lumen packages and accent lighting.

Generally, high-pressure discharge lamps of the kind mentioned in the opening paragraph either have a discharge vessel with a ceramic wall or have a quartz glass discharge vessel. Such high-pressure discharge lamps are widely used in practice and combine a high luminous efficacy with favorable color properties. The discharge vessel of the lamp contains one or several metal halides in addition to Hg and a rare gas filling.

A ceramic wall of a discharge vessel in the present description and claims is understood to be a wall made from one of the following materials: monocrystalline metal oxide (for example sapphire), translucent densely sintered polycrystalline metal oxide (for example $Al_2O_3$, YAG), and translucent densely sintered polycrystalline metal nitride (for example AlN).

A lamp of the kind mentioned in the opening paragraph is known from the English abstract of JP-A 04 002 035. The known discharge lamp comprises a discharge vessel and current supply conductors supporting the discharge vessel while installed projectively at a lamp base of an insulating material. An outer envelope or outer bulb of which one end is left open is fixed to the lamp base enclosing the discharge vessel and the current supply conductors.

A disadvantage of the known high-pressure discharge lamp is that the service life of the discharge lamp is below the desired level.

The invention has for its object to eliminate the above disadvantage wholly or partly. According to the invention, a high-pressure discharge lamp of the kind mentioned in the opening paragraph for this purpose comprises:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current supply conductor, respectively, extend to a pair of electrodes arranged in the discharge space, a lamp base of electrically insulating material supporting the discharge vessel by means of the first and second current supply conductors, the lamp base also supporting the outer envelope, the outer envelope enclosing the first and second current supply conductors, the outer envelope being connected to the lamp base in a gas-tight manner.

The current supply conductors are well protected against oxidation in that the atmosphere in the outer envelope or outer bulb is controlled. By controlling the atmosphere in the outer envelope is meant evacuating the outer envelope or providing an air-tight environment which in particular is free from oxidizing agents, like oxygen. Alternatively, controlling the atmosphere in the outer envelope does not exclude that means are provided in the outer envelope to control the atmosphere in the outer envelope. In an embodiment of the invention, the outer envelope is filled with nitrogen gas comprising, for instance, a small percentage of oxygen. Controlling the oxidation of the current supply conductors enables the current supply conductors to be positioned relatively close to the discharge vessel. Normally, press seals and/or tipped-off (quartz) tubulations are provided to reduce oxidation of the current supply conductors, leading to a bulky and lengthy high-pressure discharge lamp. For quartz discharge vessels, the press seal and current supply conductors are preferably dimensioned such as to attain the desired life by operation in air. Niobium of ceramic discharge vessels employing niobium current supply conductors oxidizes very quickly at the operating temperatures of the discharge vessel, leading to a very limited life span of the high-pressure discharge lamp.

Controlling the atmosphere in the outer envelope has the result that a simplified and compact high-pressure discharge lamp can be made. In particular, the length of the high-pressure discharge lamp can be significantly reduced. To this end, a preferred embodiment of the high-pressure discharge lamp is characterized in that the ratio of the distance $d_e$ between to electrodes to the height $h_{dl}$ of the high-pressure discharge lamp along the longitudinal axis complies with:

$$0.02 \leq \frac{d_e}{h_{dl}} \leq 0.2.$$

According to this embodiment of the invention, the height $h_{dl}$ of the high-pressure discharge lamp along the longitudinal axis can be smaller than approximately 50 mm for a distance $d_e$ between the electrodes ranging from approximately 1 mm to approximately 10 mm.

A preferred embodiment of the high-pressure discharge lamp according to the invention is characterized in that an exhaust tube for evacuating the outer envelope is provided in the lamp base or in the outer envelope. This has the advantage that the outer envelope can be evacuated via the exhaust tube after the discharge vessel and the outer envelope have been mounted on the lamp base of the high-pressure discharge lamp. In a further preferred embodiment, the exhaust tube also forms a feed-through element to a current supply conductor of the discharge vessel of the lamp. This has the advantage of a simpler lamp construction.

A preferred embodiment of the high-pressure discharge lamp according to the invention is characterized in that the lamp base is made from quartz glass, hard glass, soft glass, or a ceramic material. Preferably, the lamp base is a sintered body, preferably a glass, a glass-ceramic, or a ceramic body. Preferably, the base is colored whitish, so as to reflect extra light into usable beam angles, which increases the useful light output of the lamp effectively. Preferably, the lamp base is in the form of a plate.

The lamp base can be manufactured with a high dimensional accuracy. It is favorable when the lamp base is plane at its surface facing away from the discharge vessel. This surface may be mounted against a (lamp) holder, for example a carrier, and accordingly is a suitable surface for serving as a reference for the position of the discharge vessel.

A preferred embodiment of the high-pressure discharge lamp according to the invention is characterized in that the outer envelope is fastened to the lamp base by means of an enamel. Preferably, the enamel is provided in the form of a previously shaped ring. Using a previously shaped ring largely simplifies the manufacture of the high-pressure discharge lamp.

The high-pressure discharge lamp according to the invention has the advantage that when the lamp is in operation the discharge vessel has optically very compact virtual dimensions, which render the lamp highly suitable for use in compact luminaries. Current lamp families are based on a press-sealed quartz capsule, which can then be incorporated in reflectors. Further use of the capsule as a building block, for example in a lamp for use in open fixtures, is not possible. This is a drawback, as good positioning of the capsule within other lamp outlines is crucial for guaranteeing performance. Because of the special construction of the lamp base of the high-pressure discharge lamp according to the invention, the discharge lamp is very suitable for use in a reflector. To this end, the invention also relates to an assembly of a high-pressure discharge lamp and a reflector. In this manner, the high-pressure discharge lamp according to the invention forms a building block for use in a reflector. In another embodiment of the assembly, the reflector forms the outer envelope. In this embodiment, the lamp base of the high-pressure discharge lamp supports the reflector. Preferably, the high-pressure discharge lamp is sealed in a gastight manner to the lamp base. In addition, the reflector encloses the first and second current supply conductors and the reflector is connected to the lamp base in a gas-tight manner. The high-pressure discharge lamp forms a building block of the assembly. The relatively high positioning accuracy of the arc tube with respect to the base plate and the good dimensional reproducibility of the base plate allow its use in assemblies with different click-fit connections.

The invention will now be explained in more detail with reference to a number of embodiments and a drawing, in which:

FIG. 1A diagrammatically shows a high-pressure discharge lamp according to the invention;

FIG. 1B a cross-section of the high-pressure discharge lamp as shown in FIG. 1A;

The figures are purely diagrammatic and not drawn true to scale. Some dimensions are particularly strongly exaggerated for reasons of clarity. Equivalent components have been given the same reference numerals as much as possible in the figs.

Figure 1A:
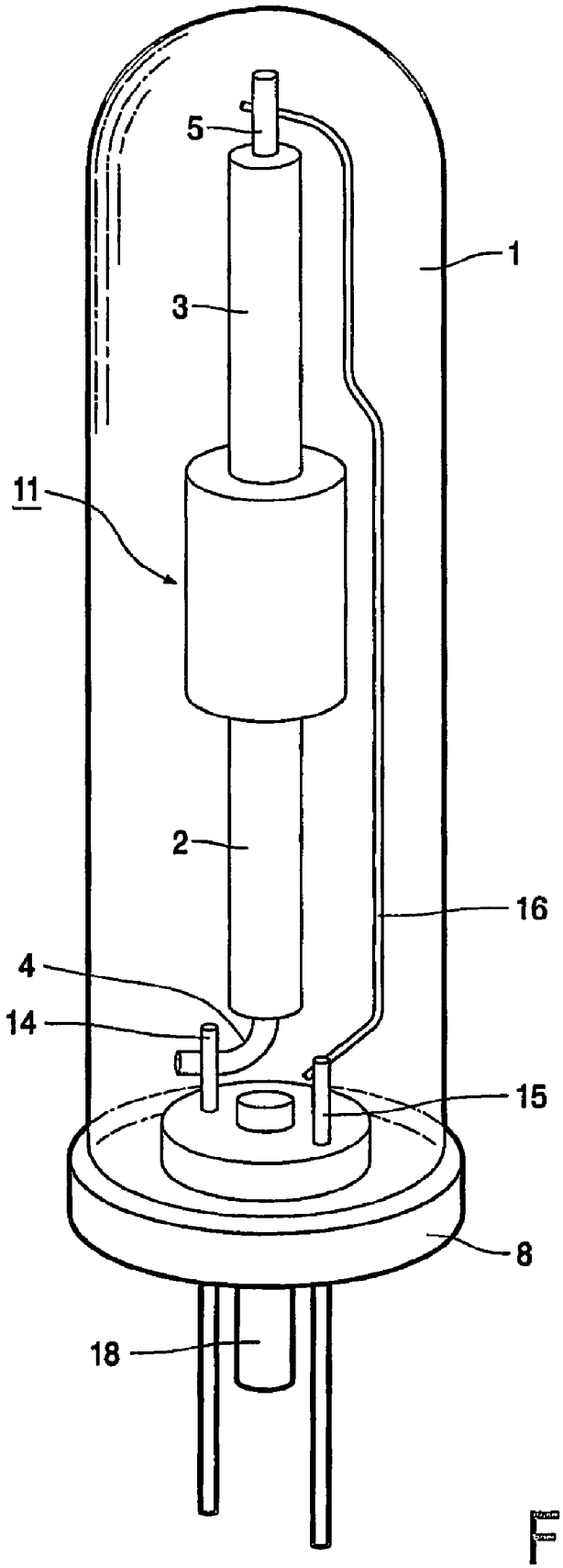
Figure 1B:
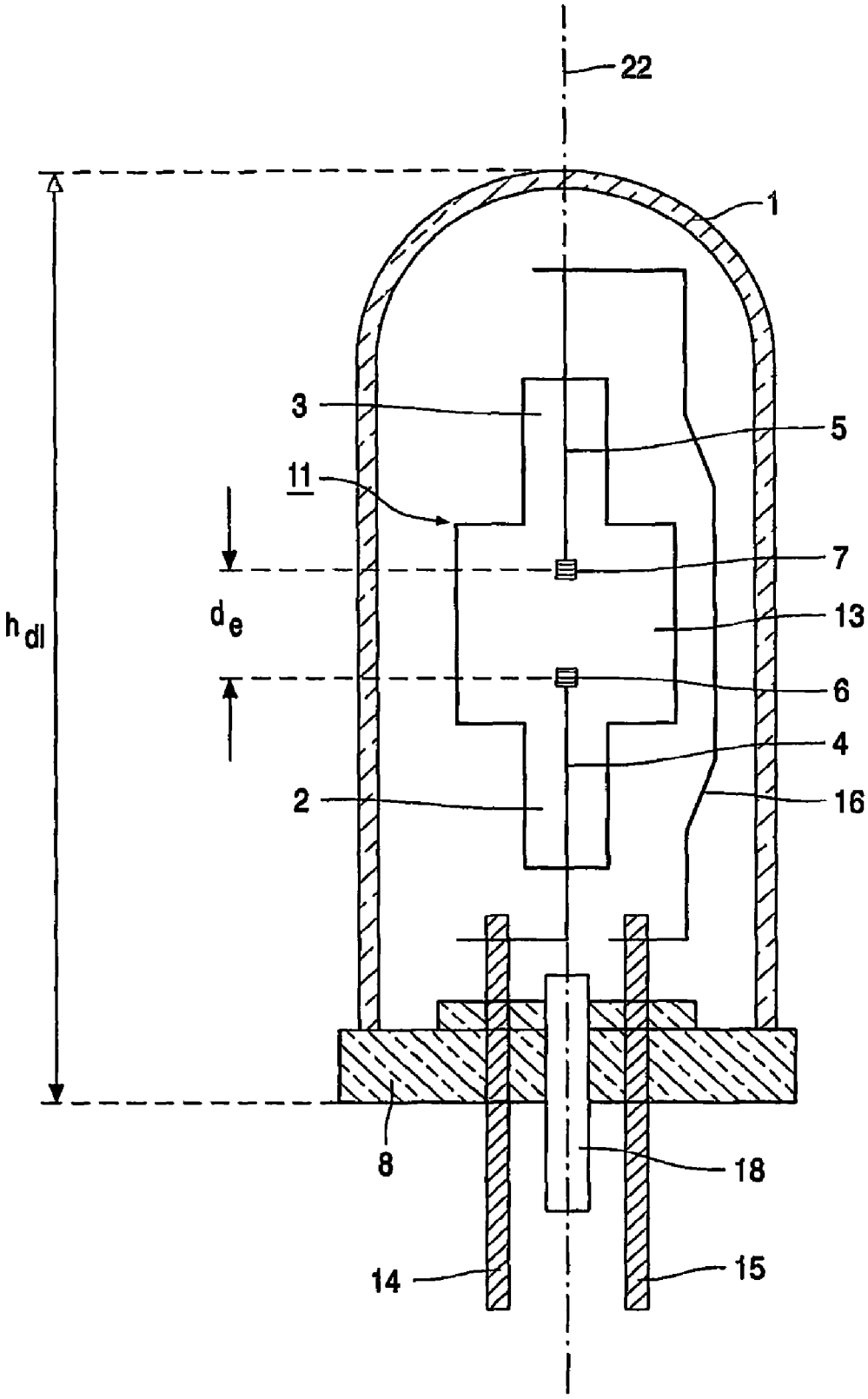

FIG. 1A shows an artist's impression of a high-pressure discharge lamp according to the invention. FIG. 1B diagrammatically shows a cross-section of the high-pressure discharge lamp as shown in FIG. 1A. The high-pressure discharge lamp comprises a discharge vessel 11 arranged around a longitudinal axis 22. The discharge vessel 11 encloses, in a gastight manner, a discharge space 13 provided with an ionizable filling comprising mercury, a metal halide, and a rare gas. In the example of FIGS. 1A and 1B, the discharge vessel 11 has a first neck-shaped portion 2 and a second, opposed neck-shaped portion 3, through which portions a first current supply conductor 4 and a second current supply conductor 5, respectively, extend to a pair of electrodes 6, 7, which electrodes 6, 7 are arranged in the discharge space 13. The high-pressure discharge lamp is further provided with a lamp base 8 made from an electrically insulating material. The lamp base 8 supports the discharge vessel 11 by means of the first and second current supply conductors 4, 5. The lamp base 8 also supports an outer bulb or an outer envelope 1. In the example of FIGS. 1A and 1B, the lamp base 8 is provided with a first contact member 14 which is connected to the first current supply conductor 4. In addition, the lamp base 8 is provided with a second contact member 15 connected to the second supply conductor 5 via a connection conductor 16 running alongside the discharge vessel 11.

In an alternative embodiment, at least one contact member is formed by a feed-through tube in the lamp base, allowing one of the current supply conductors to be fastened in said feed-through tube. Alternatively, two feed-through tubes may be provided in the lamp base. The fastening in these feed-through tubes may be done by resistance, laser welding, or crimping. An advantage of the use of feed-through tubes instead of the contact members is a greater freedom of positioning of the discharge vessel on the longitudinal axis of the high-pressure discharge lamp. This may further improve the precise positioning of the discharge vessel in the outer envelope of the high-pressure discharge lamp.

According to the invention, the outer envelope 1 is connected to the lamp base 8 in a gas-tight manner. The current supply conductors 4, 5 are well protected against oxidation in that the atmosphere in the outer envelope is controlled. Preventing oxidation of the current supply conductors 4, 5 has the result that the current supply conductors 4, 5 can be positioned relatively close to the discharge vessel 11. Press seals and/or tipped-off (quartz) tabulations can be avoided in that the atmosphere in the outer envelope is controlled, resulting in a simplified and compact high-pressure discharge lamp. Preferably, an exhaust tube 18 for evacuating the outer envelope 1 is provided in the lamp base 8. In this manner, the outer envelope 1 can be evacuated via the exhaust tube 18 after the discharge vessel 11 and the outer envelope 1 have been mounted on the lamp base 8 of the high-pressure discharge lamp. After evacuation and, if desired, provision the desired atmosphere inside the outer envelope, the exhaust tube 18 is sealed off. Preferably, a getter is used inside the outer envelope, for instance a mix of water/hydrogen/oxygen to absorb impurities. It is advantageous if the exhaust tube 18 in the lamp base 8 is made from a metal or from a NiFeCr alloy like vacovit.

The lamp base 8 is preferably made from quartz glass, hard glass, soft glass, glass-ceramic, or a ceramic material. In addition, the lamp base 8 is provided as a sintered body, preferably a sintered ceramic body. Preferably, the lamp base 8 is in the form of a plate. The lamp base 8 can be manufactured with a high dimensional accuracy. The lamp base 8 has the additional advantage that it can be made in a light color, for example white or a pale grey. By employing a material with a light color it is achieved that light emitted by the discharge vessel 11 will be reflected into usable beam angles, thereby increasing the efficiency of the luminaire or the total efficiency of the high-pressure discharge lamp assembly. It is prevented thereby that the light incident on the lamp base 8 is lost to the light beam which may be formed by means of a reflector. In addition, it is favorable when the lamp base 8 has a (flat) plane at its surface facing away from the discharge vessel 11. This surface may be mounted against a (lamp) holder, for example a carrier, for instance a reflector, and accordingly is a suitable surface for serving as a reference for the position of the discharge vessel 11. In another favorable embodiment, the surface of the lamp base 8 facing the discharge vessel has a central elevation which serves to center the discharge vessel 11 and the enamel ring with respect to the lamp base 8 during the manufacture of the high-pressure discharge lamp.

Preferably, the outer envelope 1 is made from quartz glass, hard glass or soft glass. The outer envelope 1 is, preferably, fastened to the lamp base 8 by means of an enamel of (glass) frit. It is favorable when the enamel is provided in the form of a previously shaped ring. The use of such a previously shaped ring largely improves the accuracy of the positioning of the discharge vessel 11 during the manufacture of the high-pressure discharge lamp. The choice of the enamel depends on the material of the outer envelope 1 and on the material of the lamp base 8.

Figure 2:
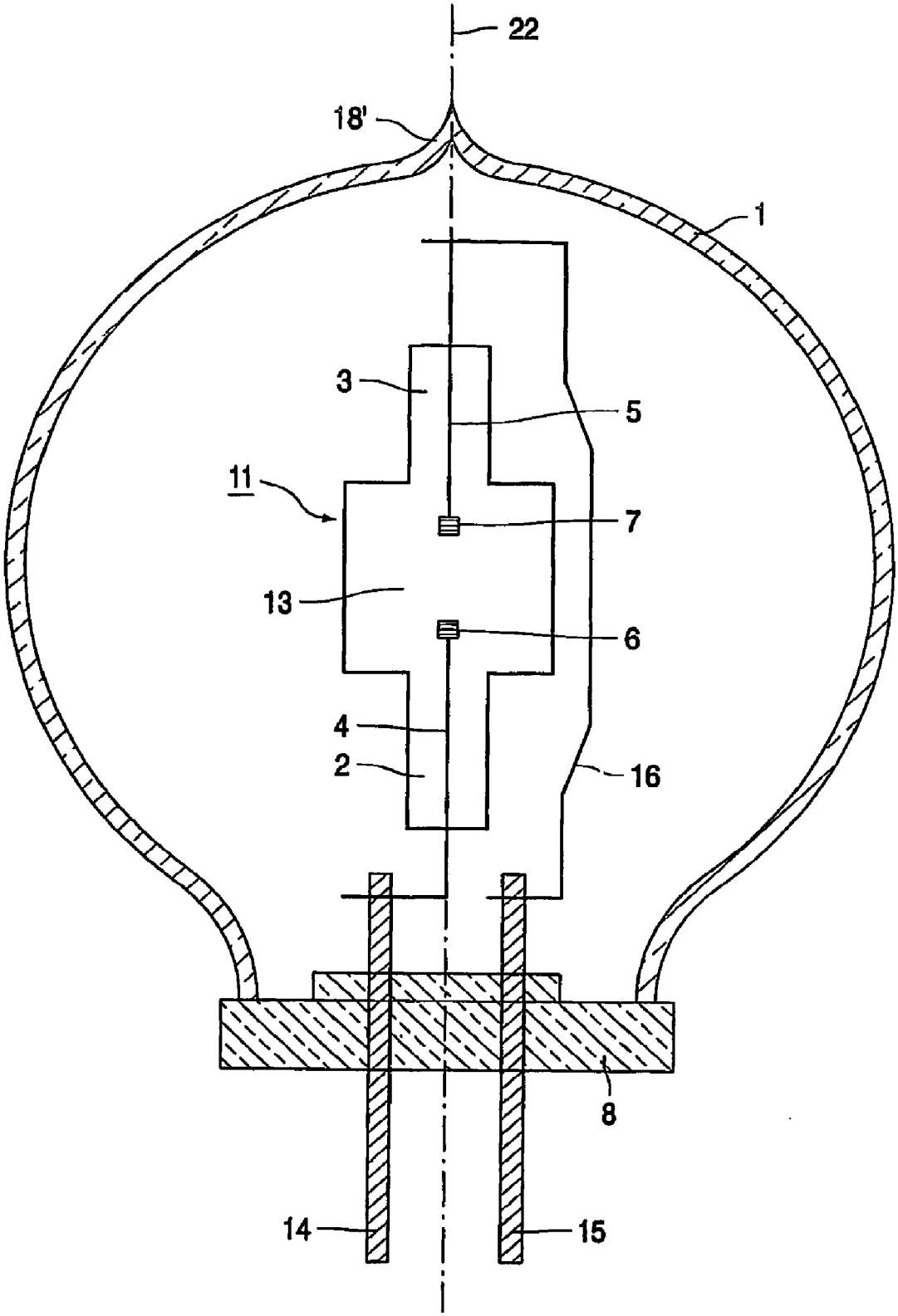
FIG. 2 shows an alternative embodiment of the high-pressure discharge lamp according to the invention.
Figure 3:
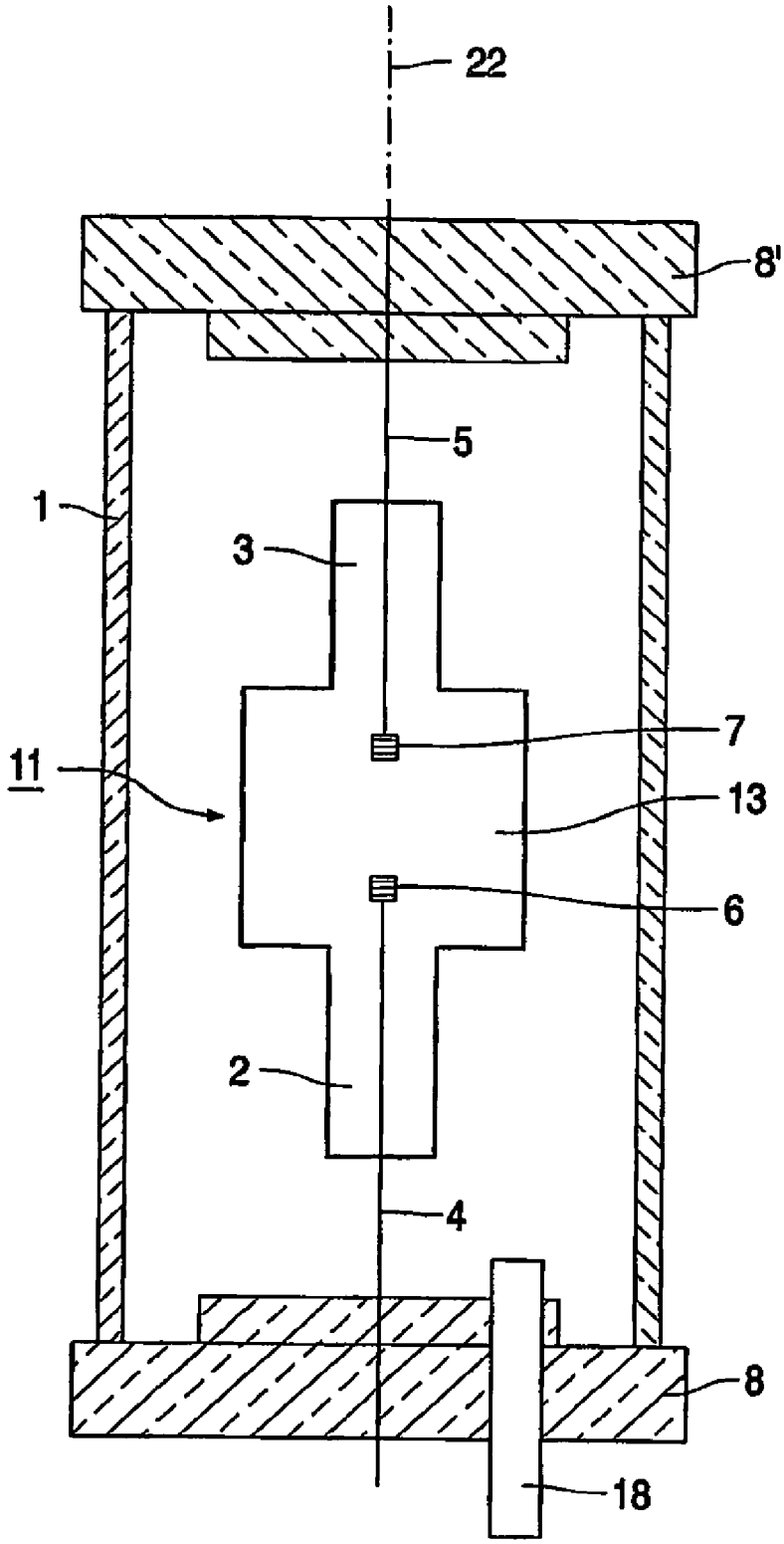
FIG. 3 shows another alternative embodiment of the high-pressure discharge lamp according to the invention.

In the example of FIGS. 1A and 1B, a substantially cylindrical outer envelope 1 is provided. FIG. 2 shows an alternative embodiment of the high-pressure discharge lamp according to the invention. In the example of FIG. 2, a substantially spherical outer envelope 1 is provided. FIG. 3 shows a further alternative embodiment of the high-pressure discharge lamp according to the invention. In the example of FIG. 3, a so-called double-ended embodiment of the high-pressure discharge lamp is shown. Two lamp bases 8, 8' are provided between a substantially cylindrical outer envelope 1. The exhaust tube 18 is, preferably, provided in only one of the lamp bases 8.

Figure 4:
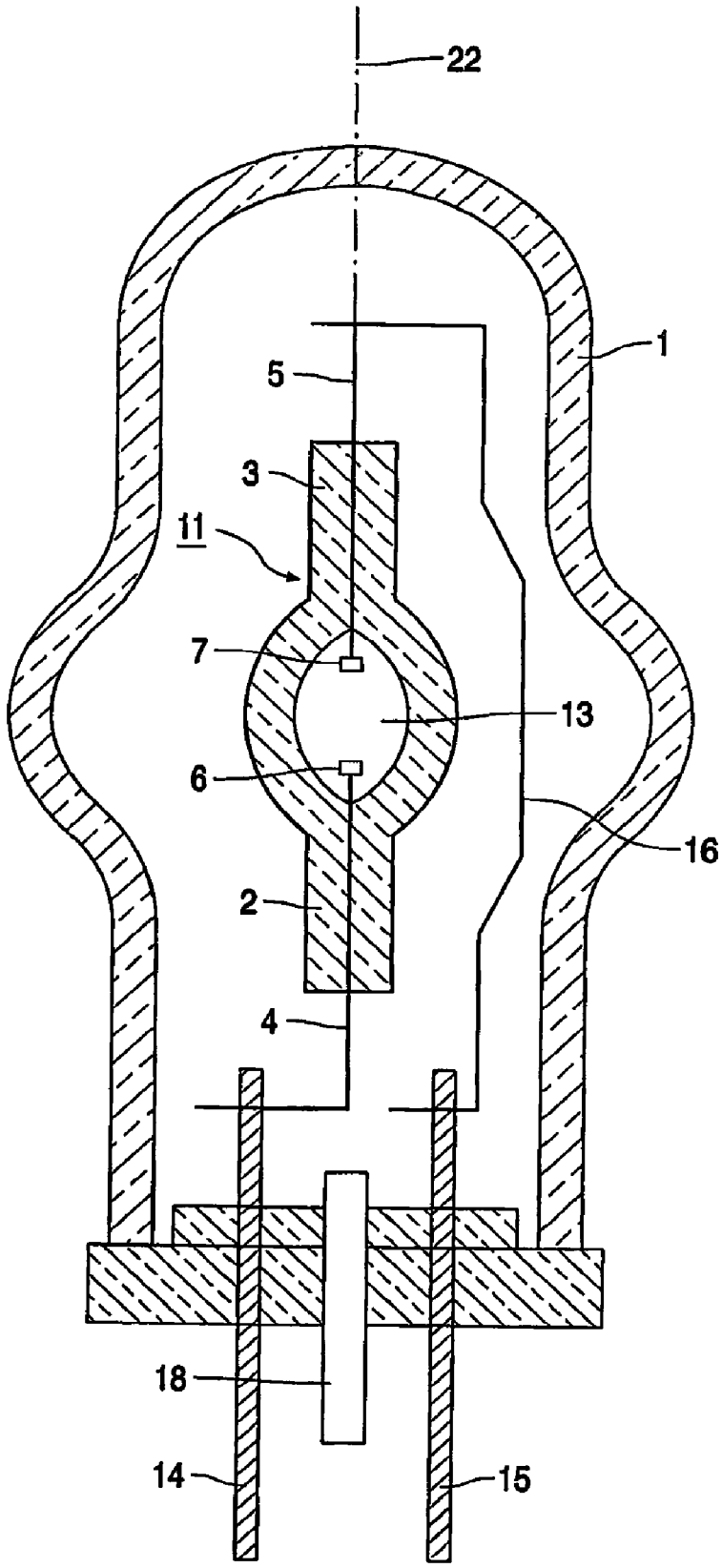
FIG. 4 shows a further alternative embodiment of the high-pressure discharge lamp according to the invention.
Figure 5:
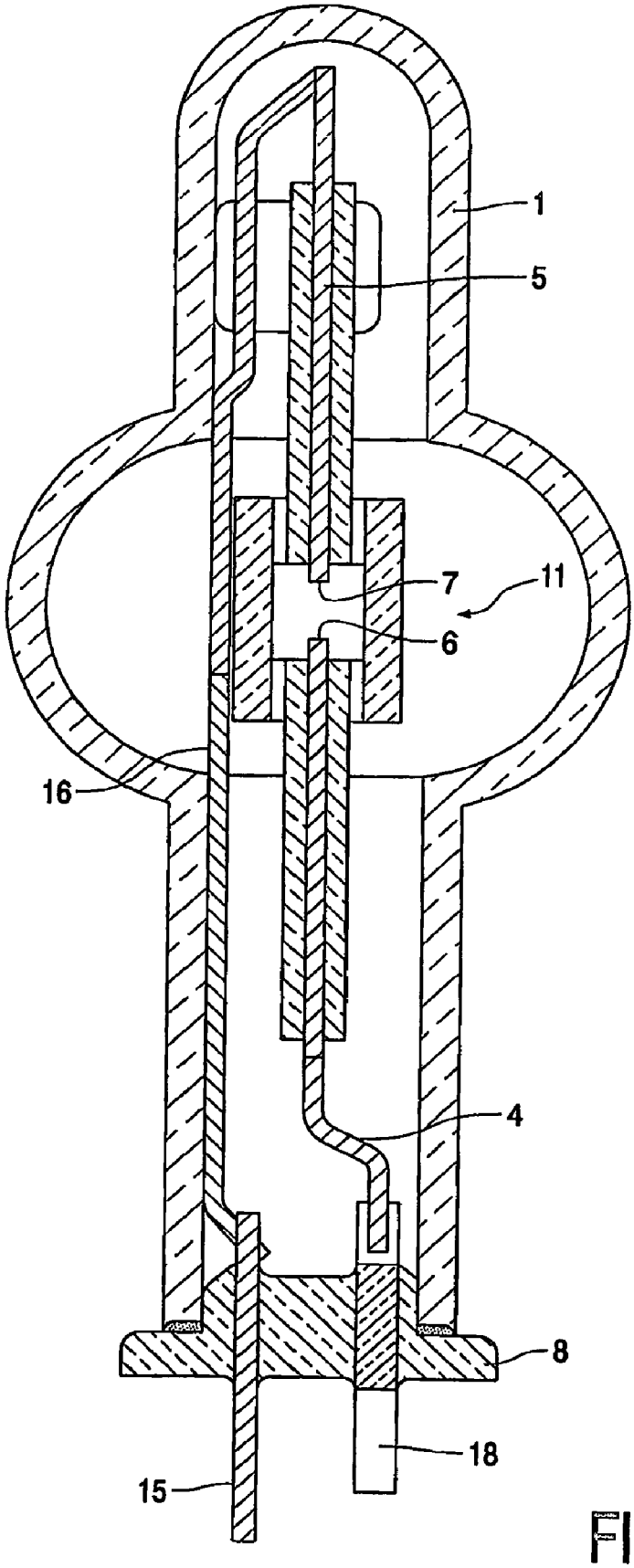
FIG. 5 shows a still further alternative embodiment of the high-pressure discharge lamp according to the invention.

In the examples of FIGS. 1A, 1B, 2 and 3, the discharge vessel 11 is made from a ceramic material. In FIG. 2 a sealed exhaust tube 18' is provided in the outer envelope 1. Providing a glass or quartz tubulation in the outer envelope means that an exhaust tube in the lamp base can be dispensed with. FIG. 4 shows yet another alternative embodiment of the high-pressure discharge lamp according to the invention in which the discharge vessel 11 is made from quartz. In this embodiment the ionizable filling in the discharge space comprises mercury, a metal halide, and a rare gas. In the example of FIG. 4, part of the outer envelope is provided in a substantially spherical form. In an alternative embodiment shown in FIG. 5, the exhaust tube 18 at the same time forms a feed-through tube to which the current conductor 14 is fastened.

The control of the atmosphere in the outer envelope means that a simplified and compact high-pressure discharge lamp can be made. In particular, the length of the high-pressure discharge lamp can be significantly reduced. To this end, a preferred embodiment of the high-pressure discharge lamp is characterized in that the ratio of the distance $d_e$ between the electrodes to the height $h_{dl}$ of the high-pressure discharge lamp along the longitudinal axis complies with:

$$0.02 \leq \frac{d_e}{h_{dl}} \leq 0.2$$

According to the invention, a simplified lamp design is provided which can be used as a building block for a family of products based on a modular capsule lamp. The discharge vessel 11 is supported on the current supply conductors 4, 5 that are fixedly connected to the base plate 8. The discharge vessel 11 as well as the current supply conductors 4, 5 are positioned in the outer envelope 1, which is kept under a controlled atmosphere. Elimination of the press seals and/or tipped-off (quartz) tubulations results in a compact high-pressure discharge lamp. Preferably, the height $h_{dl}$ of the high-pressure discharge lamp is equal to or less than 50 mm, preferably less than 40 mm. In addition, positioning problems of the discharge vessel 11 are eliminated due to the more controlled manufacture of the high-pressure discharge lamp with respect to the longitudinal axis 22 and, in addition, the discharge vessel 11 can be accurately positioned in a plane orthogonal to the longitudinal axis 22.

Figure 6:
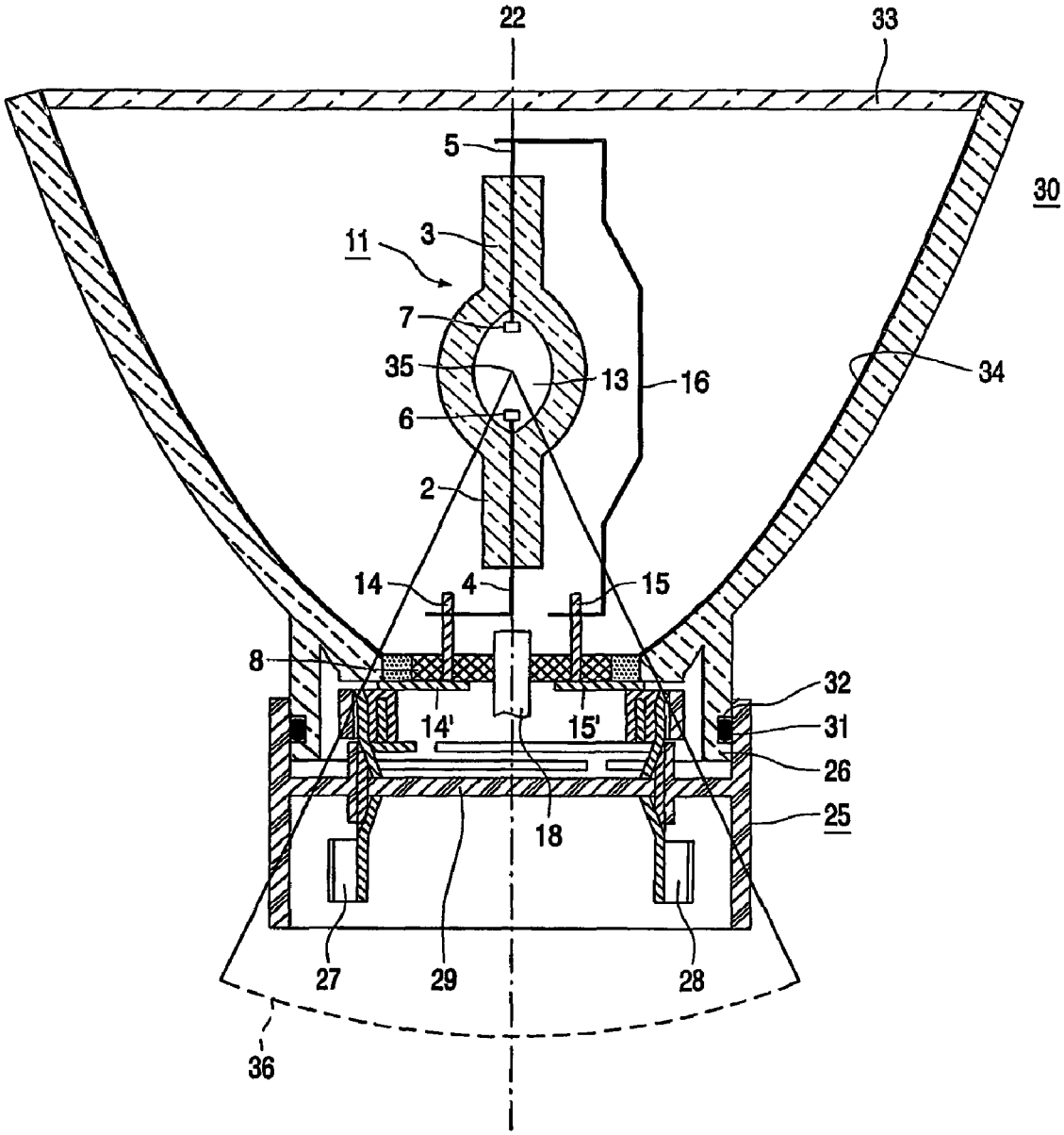
FIG. 6 shows an embodiment of an assembly of a high-pressure discharge lamp in a reflector.

Due to the compact dimensions of the discharge vessel and the high positioning accuracy of the discharge vessel 11 with respect to the lamp base 8, the discharge vessel 11 can be readily mounted in a reflector. To this end, FIG. 6 schematically shows an embodiment of an assembly of a high-pressure discharge lamp in a reflector 30 arranged around the longitudinal axis 22. The reflector 30 comprises a reflecting surface 34 on a (glass) support. The reflector 30 is provided with a transparent cover plate 33. In addition, FIG. 6 shows an adapter 25. In this configuration of a high-pressure discharge lamp with an adapter 25 and a reflector 30, where the reflector 30 is provided with a rubber ring 31 retained in a groove 32, the rubber ring 31 seals off the opening 26 between the adapter 25 and the reflector 30 in a gastight manner. The adapter 25 is provided with standardized contact terminals 27, 28 which are passed through the bottom plate 29 of the adapter 25 in a gastight manner and are connected to respective further contact members 14', 15' of the lamp cap 10. The further contact members 14', 15' are in electrical contact with the first and second contact members 14, 15, respectively.

In the example of FIG. 6, the reflector 30 forms the outer envelope which is supported by the lamp base 8, for instance by an enamel of (glass) frit. To this end, an exhaust tube 18 for evacuating the interior of the reflector 30 comprising the high-pressure discharge lamp is provided in the lamp base 8 In this manner, the reflector 30 can be evacuated via the exhaust tube 18 after the discharge vessel 11 provided on the lamp base 8 has been mounted in the reflector 30. After evacuation of the assembly of high-pressure discharge lamp and reflector 30 and, if desired, provision of the desired atmosphere inside the reflector 30, the exhaust tube 18 is sealed off. Preferably, a getter is used inside the reflector 30, for instance a mix of water/hydrogen/oxygen to absorb impurities. It is advantageous if the exhaust tube 18 in the lamp base 8 is made from a metal or from a NiFeCr alloy.

In an alternative embodiment of the assembly of a high-pressure discharge lamp and a reflector, the discharge vessel including an outer envelope is mounted in the reflector. The fact that the discharge vessel has its own environmental conditions, provides a greater freedom in designing the reflector.

It is visible in the drawing of FIG. 6 that the lamp base 8 falls substantially entirely within a cone 36 which has its apex 35 in the center of the discharge vessel 11. Preferably, the apex angle is approximately 25. The light originating from the high-pressure discharge lamp can reach the reflecting surface 34 substantially without obstruction and is reflected there at least substantially axially in the direction of the transparent cover plate 33. In an alternative embodiment, the cover plate is dome-shaped.

Since the high-pressure discharge lamp according to the invention can be given a very small constructional height, reflectors in which the discharge lamp is accommodated may be comparatively flat The discharge vessel of a 35 W high-pressure discharge lamp may have, for example, a dimension along the longitudinal axis 22 of less than 35 mm from the outside of the lamp base 8 to the top of the discharge vessel 11. If the length of the neck-shaped portions 2, 3 is reduced or the neck-shaped portions are absent, the dimension along the longitudinal axis 22 can be considerably smaller. In the assembly as shown in FIG. 6, the high-pressure discharge lamp forms a "building block" of the assembly. The positioning accuracy of the arc tube with respect to the base plate can be extremely high and is typically better than 0.25 mm. The very high dimensional reproducibility of the base plate 8 allows its use in assemblies with different click-fit connections:

a dichroic or a so-called PAR16/20 reflector, fixing in the neck within a metal ring;

a high-pressure discharge lamp with integrated ballast in the neck of a relatively large reflector (such as, for example, a so-called PAR 35). In this latter embodiment, the added advantage is the use of soldered connections to a printed circuit board It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A high-pressure discharge lamp comprising:

an outer envelope in which a discharge vessel is arranged around a longitudinal axis, the discharge vessel enclosing, in a gas-tight manner, a discharge space provided with an ionizable filling, the discharge vessel having a first and a second mutually opposed neck-shaped portion through which a first and a second current supply conductor, respectively, extend to a pair of electrodes arranged in the discharge space, a lamp base of electrically insulating material supporting the discharge vessel by means of the first and second current supply conductors, the lamp base also supporting the outer envelope, the outer envelope enclosing the first and second current supply conductors, and the outer envelope being connected to the lamp base in a gas-tight manner, wherein a length of the outer envelope generally extends in a direction parallel to the longitudinal axis except for a portion of the outer envelope in an area around the discharge vessel wherein the outer envelope is substantially spherical, wherein a ratio of a distance $d_e$ between the pair of electrodes to a height $h_{dl}$ of the high-pressure discharge lamp along the longitudinal axis complies with:

$$0.02<d_e/h_{dl}<0.2.$$

2. The high-pressure discharge lamp as claimed in claim 1, comprising an exhaust tube arranged for evacuating the outer envelope.

3. The high-pressure discharge lamp as claimed in claim 2, wherein the exhaust tube is made from a NiFeCr alloy.

4. The high-pressure discharge lamp as claimed in claim 2, wherein the exhaust tube is made from vacovit.

5. The high-pressure discharge lamp as claimed in claim 2, wherein the exhaust tube forms a feed-through tube in the lamp base, and wherein at least one of the first and second contact members is provided by the feed-through tube.

6. The high-pressure discharge lamp as claimed in claim 1, wherein the lamp base is made from a ceramic material.

7. The high-pressure discharge lamp as claimed in claim 1, wherein at least one of the first and second contact members is a feed-through tube in the lamp base.

8. The high-pressure discharge lamp as claimed in claim 1, wherein the lamp base comprises a central elevation on a surface of the lamp base facing the discharge vessel, wherein the central elevation is configured to center the discharge vessel.

9. The high-pressure discharge lamp as claimed in claim 8, comprising an enamel preformed ring, wherein the outer envelope is fastened to the lamp base by means of the enamel preformed-ring, wherein the enamel preformed-ring is preformed such that the central elevation serves to center the enamel preformed-ring with respect to the lamp base.

10. The high-pressure discharge lamp as claimed in claim 1, wherein a height of the high-pressure discharge lamp along the longitudinal axis is less than 50 mm.

11. The high-pressure discharge lamp as claimed in claim 1, wherein a distance between the electrodes is in a range from 1 mm to 10 mm.

12. A method of forming a high-pressure discharge lamp, the method comprising acts of:

positioning an outer envelope around a discharge vessel arranged around a longitudinal axis, wherein the discharge vessel encloses, in a gas-tight manner, a discharge space provided with an ionizable filling, and wherein the discharge vessel is arranged having a first and a second mutually opposed neck-shaped portion through which a first and a second current supply conductor, respectively, extend to a pair of electrodes arranged in the discharge space, wherein a length of the outer envelope generally extends in a direction parallel to the longitudinal axis except for a portion of the outer envelope in an area around the discharge vessel wherein the outer envelope is substantially spherical, providing a lamp base of electrically insulating material supporting the discharge vessel by means of the first and second current supply conductors, wherein the lamp base also supports the outer envelope, wherein the outer envelope encloses the first and second current supply conductors, wherein a ratio of a distance $d_e$ between the pair of electrodes to a height $h_{dl}$ of the high-pressure discharge lamp along the longitudinal axis complies with:

$$0.02<d_e/h_{dl}<0.2.$$

13. The method as claimed in claim 12, comprising an act of providing an exhaust tube for evacuating the outer envelope.

14. The method as claimed in claim 13, wherein the exhaust tube is made from vacovit.

15. The method as claimed in claim 13, wherein the exhaust tube forms a feed-through tube in the lamp base, and wherein at least one of the first and second contact members is provided by the feed-through tube.

16. The method as claimed in claim 12, wherein at least one of the first and second contact members is a feed-through tube in the lamp base.

17. The method as claimed in claim 12, wherein the act of providing the lamp base comprises an act of providing the lamp base with a central elevation on a surface of the lamp base facing the discharge vessel, wherein the central elevation is configured to center the discharge vessel.

18. The method as claimed in claim 17, comprising acts of:

forming an enamel ring such that the central elevation serves to center the enamel preformed-ring with respect to the lamp base, and fastening the outer envelope to the lamp base by means of the enamel ring.

* * * * *